US010465356B2

(12) United States Patent
White

(10) Patent No.: US 10,465,356 B2
(45) Date of Patent: Nov. 5, 2019

(54) SOIL IMPROVEMENT FOUNDATION ISOLATION AND LOAD SPREADING SYSTEMS AND METHODS

(71) Applicant: Geopier Foundation Company, Inc., Davidson, NC (US)

(72) Inventor: David J. White, Northfield, MN (US)

(73) Assignee: GEOPIER FOUNDATION COMPANY, INC., Davidson, NC (US)

( * ) Notice: Subject to any disclaimer, the term of this patent is extended or adjusted under 35 U.S.C. 154(b) by 0 days.

(21) Appl. No.: 16/154,076

(22) Filed: Oct. 8, 2018

(65) Prior Publication Data

US 2019/0040604 A1 Feb. 7, 2019

Related U.S. Application Data

(63) Continuation-in-part of application No. 15/067,241, filed on Mar. 11, 2016, now Pat. No. 10,094,089.

(60) Provisional application No. 62/132,488, filed on Mar. 12, 2015.

(51) Int. Cl.
*E02D 31/08* (2006.01)
*E02D 27/00* (2006.01)

(52) U.S. Cl.
CPC ..... *E02D 31/08* (2013.01); *E02D 27/00* (2013.01); *E02D 2200/1607* (2013.01); *E02D 2300/001* (2013.01); *E02D 2300/0006* (2013.01); *E02D 2300/0007* (2013.01); *E02D 2300/0015* (2013.01); *E02D 2300/0079* (2013.01)

(58) Field of Classification Search
CPC ..... E02D 31/00; E02D 27/00
See application file for complete search history.

(56) References Cited

U.S. PATENT DOCUMENTS 3,233,376 A * 2/1966 Naillon ..... E01F 8/0023 52/167.1
2006/0024131 A1* 2/2006 Wiegand ..... E01F 9/635 404/10

* cited by examiner

*Primary Examiner* — Tara Mayo-Pinnock
(74) *Attorney, Agent, or Firm* — Nexsen Pruet, PLLC; E. Eric Mills

(57) ABSTRACT

Systems and methods for soil improvement foundation isolation and load spreading are provided. The systems and methods provided herein relate to isolation of structural foundations from soil improvement elements and distributing stress from high stiffness elements to lower stiffness materials. A shear load transfer reduction system may include one or more ground improvement elements for supporting an applied load. A shear break element may be positioned above one or more ground improvement elements. The shear break elements may be configured to have low interface shear strength. Further, systems and methods are provided for creating an engineered slip surface for reducing shear stresses between a laterally loaded foundation and a rigid foundation support element and wherein two slip pads are provided that form the engineered slip surface.

19 Claims, 8 Drawing Sheets

Stress Distribution with and without disk

Plot 300

Plot 400

SOIL IMPROVEMENT FOUNDATION ISOLATION AND LOAD SPREADING SYSTEMS AND METHODS

CROSS-REFERENCE TO RELATED APPLICATIONS

The present application is a continuation-in-part application claiming priority to U.S. patent application Ser. No. 15/067,241, entitled "Soil Improvement Foundation Isolation and Load Spreading Systems and Methods," filed Mar. 11, 2016, which is related and claims priority to U.S. Provisional Patent Application No. 62/132,488, entitled "Soil Improvement Foundation Isolation and Load Spreading Systems and Methods," filed on Mar. 12, 2015; the entire disclosures of which are incorporated herein by reference.

TECHNICAL FIELD

The subject matter disclosed herein relates to soil improvement systems and methods. Particularly, the subject matter disclosed herein relates to systems and methods for isolation of structural foundations from soil improvement elements and distributing stress from high stiffness elements to lower stiffness covering materials.

BACKGROUND

Techniques for soil or ground improvement include soil mixing, jet grouting, stone columns, vibro concrete columns, controlled modulus columns, and aggregate pier techniques. Soil mixing and jet grouting involve the enhancement of in situ soil with cement binders. Vibro stone column techniques were developed in the 1940s in Germany. Vibro concrete columns were a later extension of traditional stone columns. Controlled modulus columns were developed in France in the 1980s. Aggregate pier techniques were developed by Nathaniel S. Fox and his coworkers in the early 1990s as described by U.S. Pat. No. 5,249,892, titled "Short Aggregate Piers and Method and Apparatus for Producing Same," and issued Oct. 5, 1993. Fox's technique involves the steps of drilling a hole in the ground, filling the hole incrementally with loose lifts of aggregate, and compacting the aggregate with a tamper head.

Fox also developed the IMPACT® pier technique which includes the steps of driving a hollow steel pipe in the ground, filling the pipe with aggregate stone, extracting the pipe in increments, and then advancing the pipe back downwards to compact the placed lift of aggregate in the ground. Advancements of this technique include the use of grout or concrete, sometimes in a closed, pressurized system to construct a rigid cemented aggregate element. These aggregate or cemented-aggregate elements provide vertical support for foundations. Shortcomings exist between the interface of the rigid elements and the foundation.

These more rigid soil improvement systems including vibro concrete columns, grouted or concreted aggregate piers, controlled modulus columns, and others require an aggregate transfer pad constructed following element construction between the tops of the rigid element and the bottom of foundations. Accordingly, it is desired to provide improved techniques to enhance this critical interface and to provide other soil improvement techniques and systems.

SUMMARY

The presently disclosed subject matter provides a system and methods for reducing the shear load transferred from a structural foundation of a building to a ground improvement element. Particularly, the subject matter disclosed herein relates to systems and methods for isolation of structural foundations from soil improvement elements and distributing stress from high stiffness elements to lower stiffness covering materials.

Accordingly, in some aspects, the presently disclosed subject matter provides a shear load transfer reduction system including one or more ground improvement elements for supporting applied load. The system also includes one or more shear break elements positioned above the ground improvement elements. The shear break elements are configured to have low interface shear strength and can be formed of a plastic material including, for example, high density polyethylene (HDPE), poly(vinyl chloride) (PVC), and polypropylene.

In other aspects, the presently disclosed subject matter provides a method for reducing shear (horizontal) load transfer. The method includes placing one or more ground improvement elements into the ground. The method also includes positioning one or more shear break elements having a low interface shear strength above the ground improvement elements. The method further comprises positioning a structural foundation above the shear break elements.

In other aspects, the presently disclosed subject matter provides a method for reducing stress concentration in the aggregate transfer pad constructed following element construction between the tops of the rigid element and the bottom of foundations.

Further, the presently disclosed subject matter provides systems and methods for creating an engineered slip surface for reducing shear stresses between a laterally loaded foundation and a rigid foundation support element and wherein two slip pads (shear break elements) are provided that form the engineered slip surface through the provision of one slip pad being formed of a first material and a second slip pad being formed of a second material differing from the first material.

BRIEF DESCRIPTION OF DRAWINGS

The present disclosure can be better understood by referring to the following figures. The components in the figures are not necessarily to scale, emphasis instead being placed upon illustrating the principles of the present disclosure. In the figures, like reference numerals designate corresponding parts throughout the different views.

DETAILED DESCRIPTION

The presently disclosed subject matter is described herein with specificity to meet statutory requirements. However, the description itself is not intended to limit the scope of this patent. Rather, the inventor has contemplated that the claimed subject matter might also be embodied in other ways, to include different steps, materials or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

The presently disclosed subject matter provides systems and methods for isolating friction, such as isolating the friction between ground improvement elements (also termed ground improvement inclusions or vertical inclusions) and building foundations built on top of the ground improvement elements. The presently disclosed subject matter reduces the shear loads transferred to soil improvement elements by the structures built above the elements. Specifically, the subject matter is provided to reduce the transfer of shear and lateral stresses from the structural elements to the tops of the ground improvement elements. The ground improvement elements considered in this application include any stiff vertical inclusion installed to treat the ground and support applied loads. The systems used comprise materials exhibiting low coefficients of friction to reduce the shear stress transfer.

Further, the presently disclosed subject matter provides systems and methods for creating an engineered slip surface for reducing shear stresses between a laterally loaded foundation and a rigid foundation support element and wherein two slip pads are provided that form the engineered slip surface.

Figure 1A:
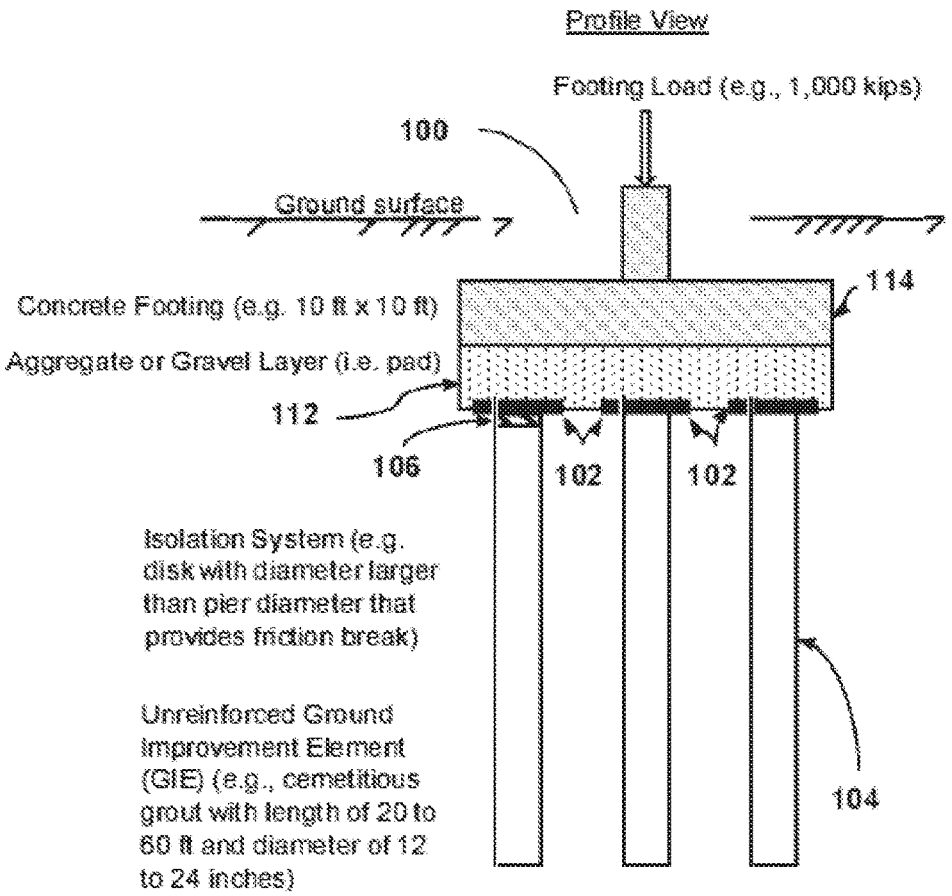
FIG. 1A and FIG. 1B illustrate a cross-sectional profile view and three-dimensional view, respectively, of an example soil improvement foundation isolation and load spreading system in situ in accordance with embodiments of the present disclosure.
Figure 1B:
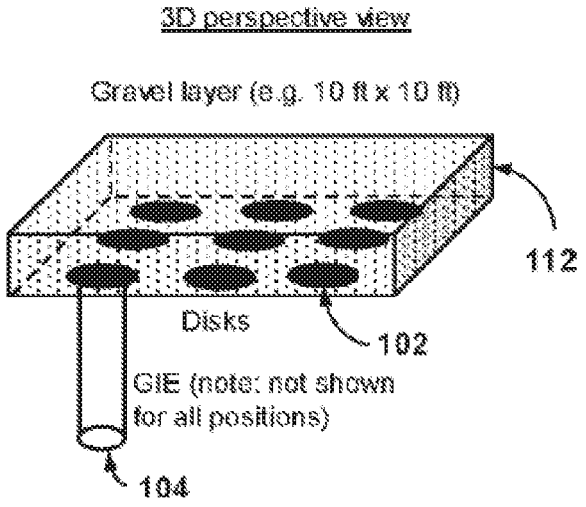

FIG. 1A and FIG. 1B illustrate a cross-sectional profile view and three-dimensional view, respectively, of an example soil improvement foundation isolation and load spreading system 100 in situ in accordance with embodiments of the present disclosure. The presently disclosed soil improvement foundation isolation and load spreading system 100 is hereafter called the "system 100." In this example, the system 100 may be used for reducing the shear load transferred from a structural foundation of a building to a ground improvement element. The system 100 may include one or more shear break element 102 positioned above a ground improvement element 104. The shear break element 102 may exhibit a low interface shear strength.

Materials comprising the presently disclosed shear break elements 102 exhibiting "low interface shear strength" as used herein refer to materials with low friction angles and low values of interface cohesion. Non-limiting examples include, but are not limited to, high density polyethylene (HDPE), poly(vinyl chloride) (PVC), polypropylene, ultra-high molecular weight polyethylene (UHMW), polytetrafluoroethylene (TEFLON®), polished metal, ceramic materials, fiberglass, composite materials with low friction angle, smooth aggregate with low friction angle, particulates with low friction angles, and the like. In some embodiments, at least one shear break element 102 comprises a plastic material. In other embodiments, at least one shear break element 102 comprises material selected from the group consisting of HDPE, PVC, and polypropylene.

Figure 2A:
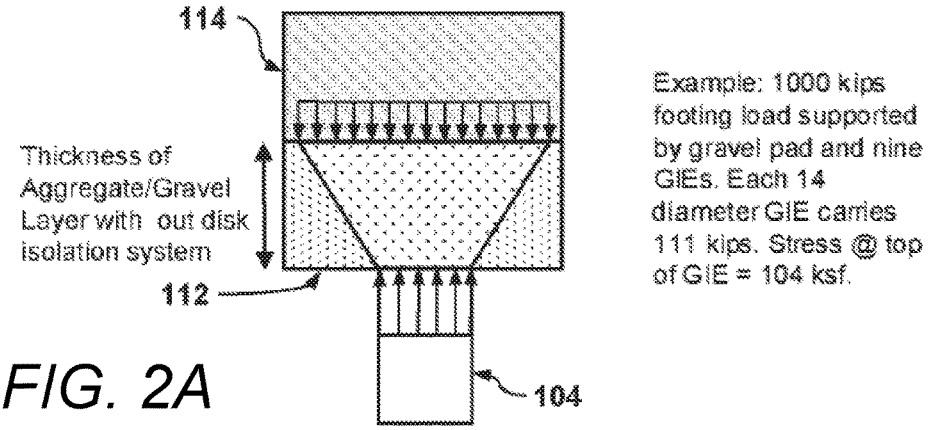
FIG. 2A illustrates a cross-sectional view of an example soil improvement foundation isolation and load spreading system that depicts stress distribution and calculated stresses absent the shear break element of the present disclosure.
Figure 2B:
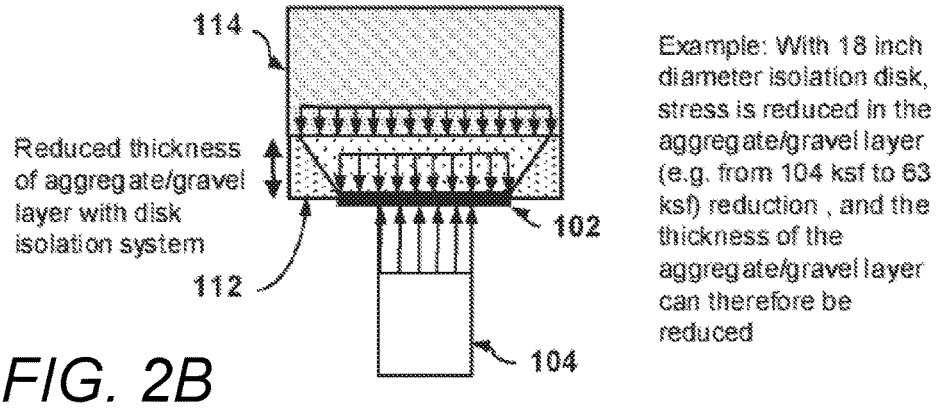
FIG. 2B illustrates a cross-sectional view of an example soil improvement foundation isolation and load spreading system that depicts stress distribution and calculated stresses when including the shear break element of the present disclosure.

FIG. 2A illustrates a cross-sectional view of an example soil improvement foundation isolation and load spreading system that depicts stress distribution and calculated stresses absent the shear break element 102. By contrast, FIG. 2B illustrates a cross-sectional view of an example soil improvement foundation isolation and load spreading system that depicts stress distribution and calculated stresses when including the shear break element 102.

In some embodiments, at least one shear break element 102 may be substantially circular. In the example shown in FIG. 2A and FIG. 2B, the shear break element 102 is an 18-inch disc-shaped element. As a non-limiting example, it may be desired for the diameter of a shear break element 102 to range from about 6 inches to more than about 48 inches. It is noted the diameter of the shear break elements may be either smaller or larger than this range.

In some embodiments, the presently disclosed system may include a granular bedding material 106 placed in between the ground improvement element 104 and one or more shear break elements 102. In other embodiments, the bedding material 106 may include, but is not limited to, sand, aggregate, other soil materials, slag, and the like. In other embodiments, the bedding material 106 may be include sand, aggregate, slag, the like, and combinations thereof.

Figure 3:
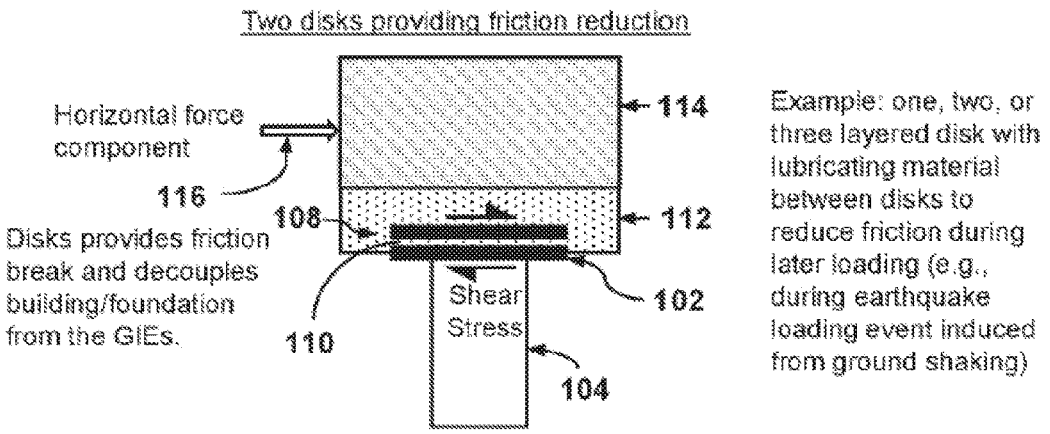
FIG. 3 illustrates a cross-sectional view of an example soil improvement foundation isolation and load spreading system that shows shear break elements to decouple a building from the ground improvement elements in accordance with embodiments of the present disclosure.

FIG. 3 illustrates a cross-sectional view of an example soil improvement foundation isolation and load spreading system that shows shear break elements 102 to decouple a building from the ground improvement elements 104 in accordance with embodiments of the present disclosure. In some embodiments, the presently disclosed system 100 may include a viscous lubricant 110 placed between two or more shear break elements 102. In other embodiments, the viscous lubricant 110 may include, but is not limited to, hydraulic oil, automotive grease, biologically-derived lubricant, the like, and combinations thereof. In other embodiments, the uppermost shear break element 102 may include a raised perimeter edge to contain and confine overlying filling materials 112.

The number of shear break elements 102 in the presently disclosed system 100 can vary from 1 to more than 1, such as 2, 3, 4, 5, or more. In some embodiments, two shear break elements 102 are placed on top of the ground improvement element 104.

Figure 4:
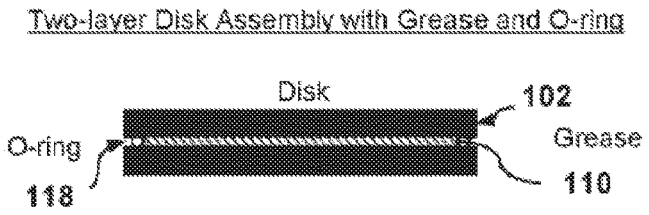
FIG. 4 illustrates a cross-sectional view that shows a two-layer shear break element in accordance with embodiments of the present disclosure.

FIG. 4 illustrated a two-layer shear break element with a lubricant 110 and a rubber O-ring 118.

In some embodiments, the presently disclosed subject matter includes an example method for constructing the presently disclosed system 100 to reduce the shear load transferred from a structural foundation of a building to a ground improvement element 104. The method includes placing the ground improvement element 104 into the ground. The method also includes placing one or more shear break elements 102 exhibiting a low interface shear strength for a high axial stiffness on top of the ground improvement element 104. The method also includes building the structural foundation of the building on top of the at least one shear break element 102.

In other embodiments, an example method may include excavating the area around the ground improvement element 104 to expose the ground improvement element 104 and the soil around the ground improvement element 104 prior to placing the shear break elements 102 on top of the ground improvement element 104.

In other embodiments, example methods include filling in the excavated area with a solid material 112 before building the structural foundation of the building on top of the shear break elements 102.

In further embodiments, the solid material 112 may include, but is not limited to, aggregate, sand, slag, earthen materials, the like, and combinations thereof. In other examples, the solid material 112 may include aggregate.

In some embodiments, bedding material 106 may be placed between the ground improvement element 104 and shear break elements 102. In other embodiments, a viscous lubricant 110 may be placed on top of at least one shear break element 102. In still other embodiments, two shear break elements 102 may be placed on top of the ground improvement element 104.

In some embodiments, the system includes two or more separate sections 108 of a material exhibiting a low coefficient of friction. In other embodiments, the sections are of sufficient thickness to avoid cracking or extensive deformation when subjected to the applied stresses over the ground improvement inclusion. While circular in shape is the preferred embodiment, alternate shapes including square, oval, and rectangular are also envisioned. In still other embodiments, shapes may extend at least to the edge of ground improvement inclusion in some or all directions. In further embodiments, the shapes may extend beyond the edge of the ground improvement elements 104.

In some embodiments, an excavation may be made following construction of the ground improvement inclusion and prior to placement of footing 114 concrete. The excavation may expose both soil and ground improvement inclusions. In other embodiments, one shear break element may be placed over the top of each of the inclusions. In an example, a thin layer of bedding material 106 may be placed over the top of the inclusion prior to shear break element 102 placement to create a more level surface and cushion. Also, a layer of viscous lubricant 110 may be placed between two shear break elements. In still other embodiments, a second shear break element 102 of similar shape and size is placed over top of the first. In further embodiments, the remainder of the footing excavation is filled with aggregate extending at least above the height of the top of the first plate. In still other embodiments, the concrete footing 114 may subsequently be constructed over the top of the backfilled excavation.

In some embodiments, the presently disclosed system and methods allow reduction of the lateral load resistance (or reduction of the shear loads transferred to ground improvement elements 104) by any amount. It may be desired to reduce the lateral load resistance by at least between about 10% to about 80%. In other embodiments, the reduction of the shear loads transferred to ground improvement elements by the structures built above the elements 104 may be at least about 50%.

This system and method will allow for horizontal movement 116 of the foundation when subjected to horizontal loads 116 without direct transfer of lateral and shear stresses to the ground improvement inclusions thereby maintaining their integrity and support characteristics under a dynamic event.

In some embodiments, the system extends beyond the edge of the ground improvement elements 104 with oversized sections of a material exhibiting sufficient stiffness to reduce stress concentration in the aggregate transfer pad.

In an example, a ground improvement inclusion measuring between 14-inches and 20-inches in diameter is considered. The ground improvement inclusion is constructed from either aggregate contained within a cementitious grout or concrete. The inclusion is constructed such that the top bears within 3 inches of the planned footing bottom. The solid shear break elements 102 are constructed from HDPE and are cylindrical. Each element measures 21 to 30 inches in diameter and between ¼-inch and ½-inch in thickness. A lubricating layer 110 of hydraulic oil or automotive grease is used to further reduce the frictional resistance at the shear break interface. A bedding layer 106 of fine sand is placed over the top of the inclusion followed by the placement of the first shear break plate. The lubricant 110 may be applied followed by the placement of the second plate of similar size over the lubricant 110.

The system and method are evaluated through a series of comparative load tests with a control group and the proposed system and method. The control features a 14-inch diameter concrete inclusion surrounded by soil. A concrete footing 114 is placed over top. A second control features the 14-inch diameter concrete inclusion surrounded by soil, followed by placement of a 9-inch thick aggregate layer over the entire area. A setup for testing of this system and method includes a 14-inch diameter concrete inclusion surrounded by soil, followed by the system described herein. In all test cases, a concrete footing 114 of consistent size was used.

The test was performed by applying a constant vertical load by use of a hydraulic jack and a reaction frame. A horizontal load 116 is applied and lateral deflections are measured. The validity of the shear break device is confirmed by the reduction of the lateral load resistance between the two controls and the test case by at least 30%.

ADDITIONAL EMBODIMENTS

Further, the presently disclosed subject matter provides systems and methods for creating an engineered slip surface for reducing shear stresses between a laterally loaded foundation and a rigid foundation support element as described hereinbelow with reference to FIG. 5, FIG. 6A, FIG. 6B, FIG. 7, and FIG. 8.

Figure 5:
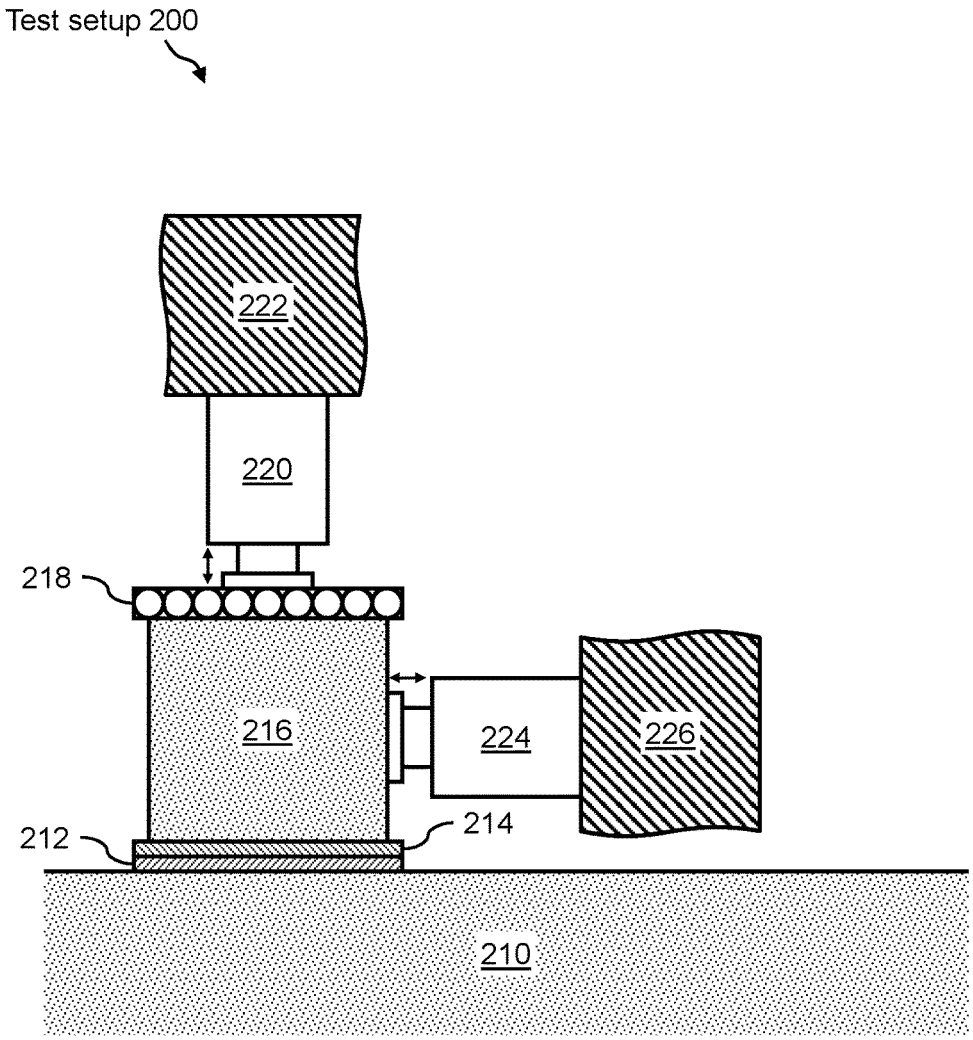
FIG. 5 illustrates a side view of an example of a test setup for testing an engineered slip surface for reducing shear stresses between a laterally loaded foundation and a rigid foundation support element and wherein two slip pads are provided that form the engineered slip surface.

Namely, FIG. 5 shows a side view of an example of a test setup 200 for testing an engineered slip surface for reducing shear stresses between a laterally loaded foundation and a rigid foundation support element and wherein two slip pads are provided that form the engineered slip surface. The test setup 200 is, for example, a full scale lateral field test setup.

The test setup 200 includes a concrete footing or pad 210, a lower slip pad 212 atop the concrete footing or pad 210, an upper slip pad 214 atop the lower slip pad 212, a concrete pier or column 216 atop the upper slip pad 214, and a lubricated roller system 218 atop the concrete pier or column 216. A vertical jack 220 is arranged between the top of the lubricated roller system 218 and a stationary anchor 222, wherein the vertical jack 220 and the stationary anchor 222 provide a vertical load to the concrete pier or column 216

(testing in an "upside down pier" manner). Further, a lateral jack 224 is arranged between the side of the concrete pier or column 216 and a stationary anchor 226, wherein the lateral jack 224 and the stationary anchor 226 provide a horizontal load to the concrete pier or column 216.

Figure 6A:
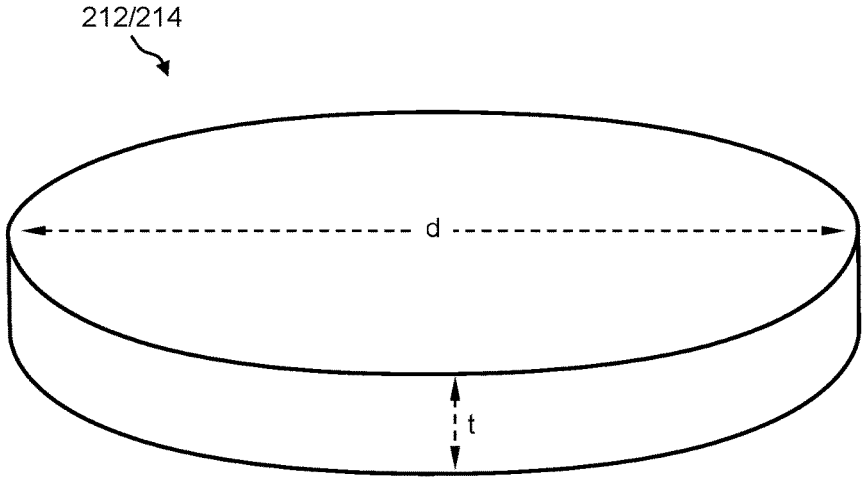
FIG. 6A and FIG. 6B illustrate perspective views of examples of the slip pads for forming the engineered slip surface.
Figure 6B:
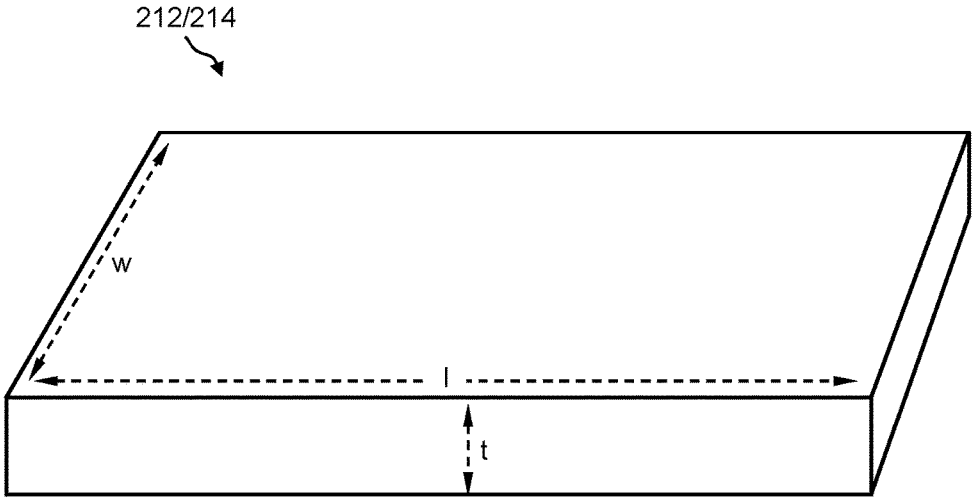

Referring now to FIG. 6A and FIG. 6B are perspective views of examples of the lower slip pad 212 and/or the upper slip pad 214. Namely, FIG. 6A shows an example of circular- or disk-shaped slip pads 212/214 with a diameter d and a thickness t. FIG. 6B shows an example of square- or rectangular-shaped slip pads 212/214 with a length l, a width w, and a thickness t. These are exemplary only. The slip pads 212/214 can be any shape, such as, but not limited to, circular, square, rectangular, triangular, and the like. The lower slip pad 212 and the upper slip pad 214 can have the same or different dimensions and/or thicknesses. Further, the lower slip pad 212 and the upper slip pad 214 can be formed of the same or different materials.

EXAMPLE I

In one example of the present subject matter, a method of using two discrete and similar plastic slip pads (e.g., lower slip pad 212 and upper slip pad 214) to create an engineered slip surface for reducing shear stresses between a laterally loaded foundation and a rigid foundation support element was demonstrated in full-scale field tests. Full-scale lateral load field tests were conducted in an upside-down testing apparatus where the vertical load was applied with a 175-ton hydraulic jack pushing against a vertical reaction frame onto a 14-in diameter rigid foundation support element. The load was transferred downward onto a set of two discrete slip pads and then onto an 8-ft square concrete pad that was anchored in the ground to prevent both vertical and lateral movement. A lateral load was applied with a 100-ton hydraulic jack (i.e., lateral jack 224) and lateral reaction frame (i.e., stationary anchor 226) to the side of the 14-in diameter rigid foundation support element (i.e., concrete pier or column 216) to transfer shear stresses to the interface between the discrete slip pads. A lubricated roller system (i.e. lubricated roller system 218) was positioned between the bottom of the vertical 175-ton hydraulic jack (i.e., vertical jack 220) and top of the 14-in diameter rigid foundation support element to transfer vertical load yet allow for horizontal translation of the rigid foundation support element when loaded laterally. In this example, the discrete pads were constructed from two 0.25-in thick sheets of HDPE. The upper pad (foundation support element side) was 14-in square and the lower pad (concrete pad side) was 20-in square.

The tests were performed by first applying the vertical load to a 14-in diameter rigid foundation support element centered above the two discrete plastic pads and the anchored 8-ft square concrete pad. Once the desired vertical stress increment was achieved, a lateral load was applied to the side of the 14-in diameter rigid foundation support element and increased incrementally to the maximum value at which the friction between the two discrete pads was overcome and the rigid foundation support element and upper pad began to translate horizontally relative to the lower pad and anchored concrete pad. The coefficient of friction (COF) between the two pads was recorded as the ratio of the maximum applied lateral load to the applied vertical load. This process was performed for six different vertical loads, 75 kips, 112.5 kips, 150 kips, 187.5 kips, 225 kips, and 262.5 kips, respectively.

Figure 7:
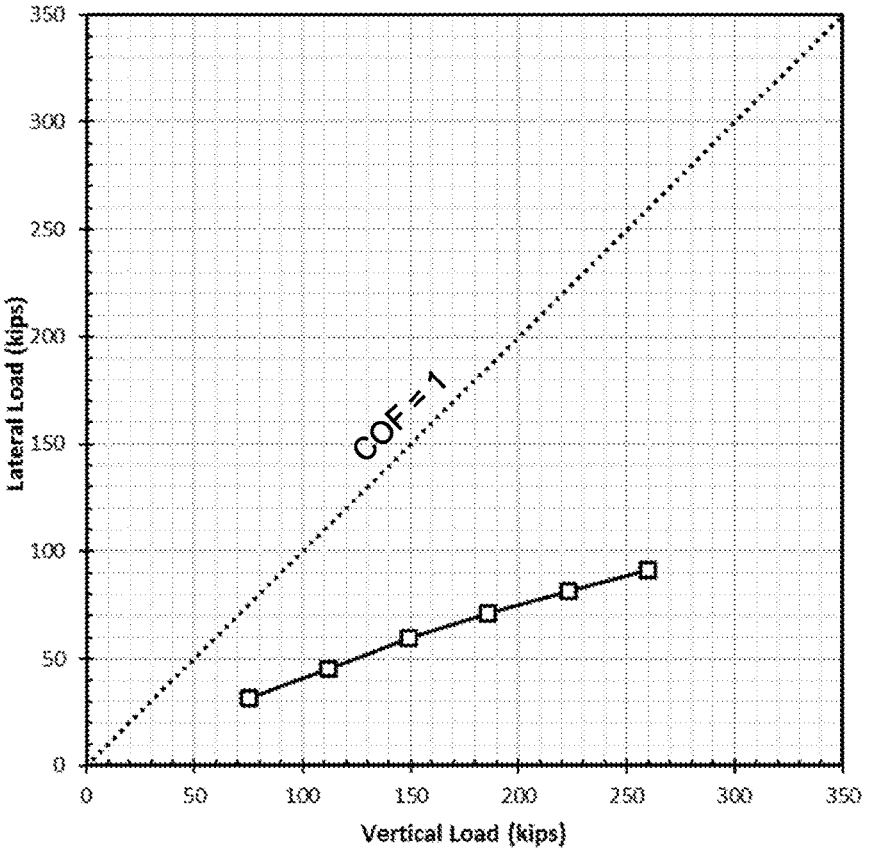
FIG. 7 shows a plot of the lateral load test results for slip pads constructed of similar plastics.

FIG. 7 shows a plot 300 of the lateral load test results for slip pads constructed of similar plastics (i.e., HDPE). Namely, the plot 300 shows the results of the lateral load tests for this example where the vertical load (in kips) is plotted on the horizontal axis and the corresponding lateral load (in kips) required to break the friction between the two discrete pads at each vertical load increment is plotted on the vertical axis. A straight line representing the coefficient of friction (COF) equal to 1 or similarly a friction angle of 45 degrees is plotted for reference. The measured COF values for this example ranged from a maximum value of 0.42 (22.7° friction angle) at the smallest vertical load of 62.5 kips to a minimum value of 0.35 (19.4° friction angle) at the largest vertical load of 262.5 kips. The average COF was approximately 0.39 (21.1° friction angle).

EXAMPLE II

In another example of the present subject matter, a method of using two discrete and dissimilar plastic pads to create an engineered slip surface for reducing shear stresses between a laterally loaded concrete pad and a rigid foundation support element was demonstrated in full-scale field tests. Full-scale lateral load field tests were conducted in similar fashion to that described in the previous example with the addition of an extended hold time at the maximum vertical load was held for approximately 15 hours before the lateral loads were applied to allow for any inter-material deformations to occur.

The discrete plastic pads in this example were constructed of dissimilar plastics where the upper slip pad 214 was made of different material in comparison to the lower pad 212. Three different plastics were used for a total of two load testing combinations. The first slip pad combination included a 0.25-in thick, 14-in square HDPE sheet for the upper pad 214 (rigid foundation support element side) with a 0.25-in thick, 20-in square acrylonitrile butadiene styrene (ABS) sheet for the lower pad 212 (concrete pad side). The second combination featured a 0.25-in thick, 14-in square HDPE sheet for the upper pad 214 (rigid foundation support element side) with a 0.25-in thick, 20-in square PVC sheet for the lower pad 212 (concrete pad side).

In this example, the lateral load tests were performed for four different vertical loads, 75 kips, 150 kips, 225 kips, and 300 kips, respectively, with the 15-hour hold time occurring at the maximum vertical load of 300 kips.

Figure 8:
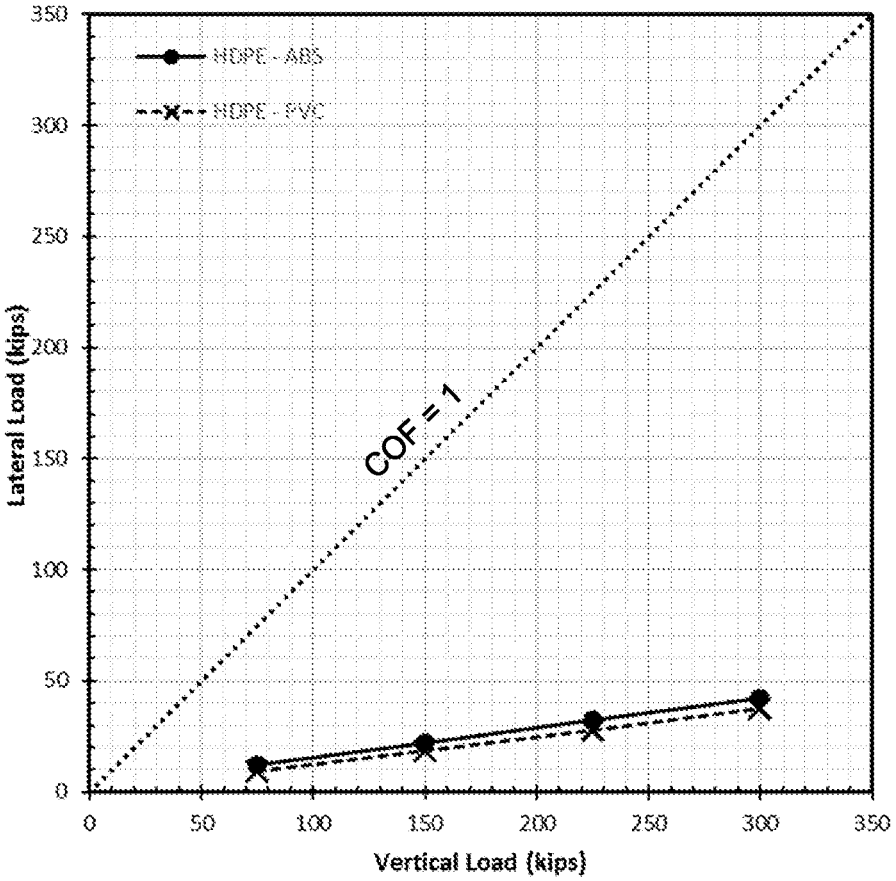
FIG. 8 shows a plot of the lateral load test results for slip pads constructed of dissimilar plastics.

FIG. 8 shows a plot 400 of the lateral load test results for slip pads constructed of dissimilar plastics. Namely, the plot 400 shows the results of the lateral load tests for this example where the vertical load (in kips) is plotted on the horizontal axis and the corresponding lateral load (in kips) required to break the friction between the two discrete pads at each vertical load increment is plotted on the vertical axis. A straight line representing the coefficient of friction (COF) equal to 1 or similarly a friction angle of 45 degrees is plotted for reference. The first slip pad combination of HDPE over ABS, represented by the solid black line with circular markers, had measured COF values ranging from a maximum value of 0.16 (9.3° friction angle) at the smallest vertical load of 75 kips to a minimum value of 0.14 (8.0° friction angle) at the largest vertical load of 300 kips following the 15 hour hold period. The average COF for this combination was approximately 0.15 (8.5° friction angle). The second slip pad combination of HDPE over PVC, represented by the dashed line with x markers, had measured COF values of approximately 0.12 (7.1° friction angle) with little to no variance between the different vertical loads.

The advantage of using two discrete slip pads constructed of dissimilar plastic materials resulted in lower coefficient of friction values which reduced the lateral load required for shear separation between the rigid foundation support element and the structural concrete pad.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

What is claimed is:

1. A shear load transfer reduction system comprising:

at least one ground improvement element for supporting applied loads;

two or more shear break elements positioned above the at least one ground improvement element, wherein the two or more break elements are configured to have low interface shear strength and are formed of one shear break element comprising a first material and one shear break element comprising a second material differing from the first material; and a bedding material placed between the at least one ground improvement element and the two or more shear break elements, the bedding material selected from the group consisting of sand, aggregate, and slag.

2. The system of claim 1, wherein the first or second materials comprise a plastic material.

3. The system of claim 1, wherein the first or second materials comprise material selected from the group consisting of high density polyethylene (HDPE), poly(vinyl chloride) (PVC), and polypropylene.

4. The system of claim 1, wherein the two or more shear break elements are substantially circular.

5. The system of claim 4, wherein the diameter of the two or more shear break elements range from 6 inches to 48 inches.

6. The system of claim 1, further comprising a viscous lubricant placed between the two or more shear break elements.

7. The system of claim 6, wherein the viscous lubricant is selected from the group consisting of hydraulic oil and automotive grease.

8. A method for reducing shear load transfer, the method comprising:

placing at least one ground improvement element into the ground;

positioning two or more shear break elements above the at least one ground improvement element, wherein the two or more break elements are configured to have low interface shear strength and are formed of one shear break element comprising a first material and one shear break element comprising a second material differing from the first material;

positioning a structural foundation above the two or more shear break elements; and placing a bedding material between the at least one ground improvement element and the two or more shear break elements, the bedding material selected from sand, aggregate, and slag.

9. The method of claim 8, further comprising excavating an area surrounding the at least one ground improvement element to expose the at least one ground improvement element and the soil within the area.

10. The method of claim 9, further comprising filling in the excavated area using a solid material before positioning the structural foundation above the two or more shear break elements.

11. The method of claim 10, wherein the solid material comprises aggregate.

12. The method of claim 8, wherein the first or second materials comprise a plastic material.

13. The method of claim 8, wherein the first or second materials comprise material selected from the group consisting of high density polyethylene (HDPE), poly(vinyl chloride) (PVC), and polypropylene.

14. The method of claim 8, wherein the two or more shear break elements are substantially circular.

15. The method of claim 14, wherein the diameter of the two or more shear break elements range from 6 inches to 48 inches.

16. The method of claim 8, further comprising placing a viscous lubricant between the two or more shear break elements.

17. The method of claim 16, wherein the viscous lubricant is selected from the group consisting of hydraulic oil and automotive grease.

18. A shear load transfer reduction system comprising:

at least one ground improvement element for supporting applied loads;

two or more shear break elements positioned above the at least one ground improvement element, wherein the two or more break elements are configured to have low interface shear strength and are formed of one shear break element comprising a first material and one shear break element comprising a second material differing from the first material; and a granular bedding material placed between the at least one ground improvement element and the two or more shear break elements.

19. A method for reducing shear load transfer, the method comprising:

placing at least one ground improvement element into the ground;

positioning two or more shear break elements above the at least one ground improvement element, wherein the two or more break elements are configured to have low interface shear strength and are formed of one shear break element comprising a first material and one shear break element comprising a second material differing from the first material;

positioning a structural foundation above the two or more shear break elements; and placing a granular bedding material between the at least one ground improvement element and the two or more shear break elements.

* * * * *